US005322075A

United States Patent [19]

Deevi et al.

[11] Patent Number: 5,322,075

[45] Date of Patent: Jun. 21, 1994

[54] HEATER FOR AN ELECTRIC FLAVOR-GENERATING ARTICLE

[75] Inventors: Seetharama C. Deevi, Midlothian; Mohammad R. Hajaligol, Richmond; Herbert Herman, Port Jefferson; Charles T. Higgins, Richmond; Michael L. Watkins, Chester; Bruce E. Waymack, Prince George; Sung Yi, Midlothian, all of Va.

[73] Assignee: Philip Morris Incorporated, New York, N.Y.

[21] Appl. No.: 943,318

[22] Filed: Sep. 10, 1992

[51] Int. Cl.[5] ..... A24F 1/22

[52] U.S. Cl. ..... 131/194

[58] Field of Search ..... 131/194

[56] References Cited

U.S. PATENT DOCUMENTS

| | | | |
|---|---|---|---|
| 3,444,183 | 5/1969 | Hubbuch | 260/32.6 |
| 3,496,336 | 2/1970 | Hingorany et al. | 219/464 |
| 3,563,916 | 2/1971 | Takashima et al. | 252/511 |
| 4,016,061 | 4/1977 | Wasa et al. | 204/192 |
| 4,194,108 | 3/1980 | Nakajima et al. | 219/216 |
| 4,203,025 | 5/1980 | Nakatani et al. | 219/216 |
| 4,259,564 | 3/1981 | Ohkubo et al. | 219/216 |
| 4,659,912 | 4/1987 | Derbyshire | 219/535 |
| 4,822,538 | 4/1989 | Yoshida et al. | 264/29.4 |
| 4,845,533 | 7/1989 | Pryor et al. | 357/2 |
| 4,922,901 | 5/1990 | Brooks et al. | 128/203.2 |
| 4,947,874 | 8/1990 | Brooks et al. | 131/329 |
| 4,947,875 | 8/1990 | Brooks et al. | 131/330 |
| 4,981,522 | 1/1991 | Nichols et al. | 131/274 |
| 5,060,671 | 10/1991 | Counts et al. | 131/329 |
| 5,093,894 | 3/1992 | Deevi et al. | 392/390 |
| 5,095,921 | 3/1992 | Losee et al. | 131/194 |

FOREIGN PATENT DOCUMENTS

| | | | |
|---|---|---|---|
| 0295122 | 6/1988 | European Pat. Off. | A24F 47/00 |
| 0358002 | 8/1989 | European Pat. Off. | A24F 47/00 |
| 0358114 | 8/1989 | European Pat. Off. | A61M 15/00 |
| WO89/06480 | 12/1988 | World Int. Prop. O. | H05B 3/10 |

*Primary Examiner*—Theatrice Brown

*Attorney, Agent, or Firm*—Kevin B. Osborne; James E. Schardt; Charles E. B. Glenn

[57] ABSTRACT

A smoking article is provided in which a flavor-generating medium is heated electrically to release an aerosol for inhalation by a consumer. The smoking article includes a heater having resistive heating elements printed on a flexible substrate. The heater can be manufactured by circuit board mass production techniques, and can be formed to fit inside an article of the same shape and size as a conventional cigarette. Alternatively, the heater comprises an array of heating elements onto which charges of flavor-generating medium are deposited. The heating elements are connected in a manner which allows the temperature increase in the heater to be concentrated in individually selected heating elements, and requires a minimal number of electrical conductors.

57 Claims, 2 Drawing Sheets

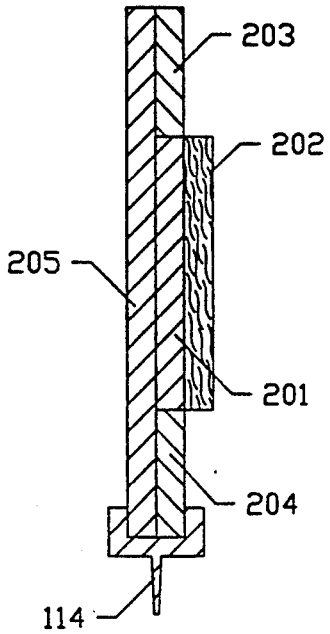
FIG. 3
FIG. 4
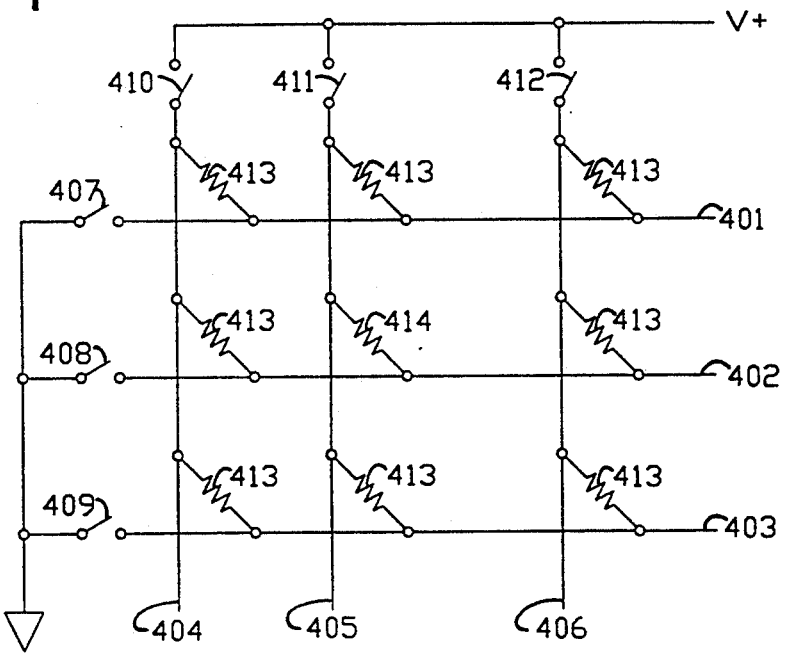

HEATER FOR AN ELECTRIC FLAVOR-GENERATING ARTICLE

BACKGROUND OF THE INVENTION

1. Field of the Invention

The present invention relates to flavor-generating articles in which a flavor-generating medium, for example tobacco, is heated electrically to produce a flavor-containing aerosol for delivery to a consumer. More particularly, the invention relates to electrical resistance heaters for such articles.

2. Description of Related Art

Smoking articles utilizing electrical power for heating and thereby releasing flavor from tobacco and other compounds may have certain advantages over conventional smoking articles. For example, electrically-heated smoking articles produce the taste and sensation of smoking, but do not burn tobacco, and thus do not produce all the normal byproducts of tobacco combustion. Also, electrically-heated articles do not produce sidestream smoke.

One previous attempt to provide an electrically-heated smoking article involved heating an entire bed of flavor-generating materials, each time the consumer inhaled, using a single heating element. Another electrically-heated smoking article heated localized charges of flavor-generating material selectively, with a new charge being heated each time the consumer inhaled.

There have been various technical problems with electrically-heated articles. For example, if a large number of heating elements are provided for heating individual flavor-generating charges, the number of electrical connections necessary to supply power to the heating elements becomes large. This can increase the cost of the heater. Also, it may be difficult to mass-produce heaters having individually selectable heating elements. It may also be difficult to manufacture heaters of a suitable shape and size to fit into a smoking article similar in size to a conventional cigarette.

In view of the foregoing, it is an object of the invention to provide a heater which uses a minimal number of electrical connections to heat selectively any one of several individual flavor-generating charges.

It is another object of the invention to provide a heater which can be manufactured by mass-production techniques.

It is a further object of the invention to provide a heater which can be shaped into a configuration suitable for incorporation into a smoking article of the same shape and size as a conventional cigarette.

SUMMARY OF THE INVENTION

These and other objects of the invention are accomplished in accordance with the principles of the present invention by providing an electrical resistance heater manufactured by printing conductive and resistive materials on a flexible substrate. The heater can be manufactured using mass-production printed circuit techniques. The flexibility of the substrate allows the heater to be shaped into a tubular form suitable for incorporation into a smoking article of the same size and shape as a conventional cigarette.

The heater may include several heating elements which are connected in a two-dimensional array configuration. The two-dimensional array requires a minimum number of electrical connections to selectively concentrate power on an individual heater element.

BRIEF DESCRIPTION OF THE DRAWINGS

The above and other objects of the invention will be apparent from the following detailed description, taken in connection with the accompanying drawings, in which like reference numerals refer to like parts throughout, and in which:

FIG. 3 is a cross-sectional view of the heater of FIG. 2 taken along lines 3—3; and FIG. 4 is a schematic diagram of an alternative embodiment of a heater according to the present invention.

DETAILED DESCRIPTION OF THE PREFERRED EMBODIMENTS

The heater of the present invention may be used in an electric flavor-generating article, which itself includes a source of electrical energy, electrical or electronic controls for delivering electrical energy from the source of electrical energy to the heaters in a controlled manner, and a flavor-generating medium in contact with the heater. When the heater heats the flavor-generating medium, flavor-containing substance—i.e., a vapor or aerosol, or mixture thereof, containing flavored vapors or aerosols or other vapor or aerosol components—is generated or released and can be drawn in by the consumer.

The flavor-generating medium can be any material that, when heated, releases a flavor-containing substance. Such materials can include tobacco, tobacco condensates or fractions thereof (condensed components of the smoke produced by the combustion of tobacco, leaving flavors and, possibly, nicotine), or tobacco extracts or fractions thereof, deposited on an inert substrate. These materials, when heated, generate or release a flavor-containing substance which can be drawn in by the consumer. Any of these flavor-generating media can also include an aerosol-forming material, such as glycerine or water, so that the consumer has the perception of inhaling and exhaling "smoke" as in a conventional cigarette. A particularly preferred material is a composition such as that described in commonly-assigned U.S. Pat. No. 4,981,522, hereby incorporated by reference in its entirety, which describes pelletized tobacco containing glycerine (as an aerosol-forming ingredient) and calcium carbonate (as a filler). As used in the present invention, the composition, instead of being formed into pellets, would be deposited as a coating (in conjunction with adhesion agents such as citrus pectin) onto heating elements.

The flavor-generating medium is divided into individual charges, each representing one puff of the article. It is possible to mimic a conventional cigarette by providing a number of charges of flavor-generating medium equal to an average number of puffs per cigarette, e.g., eight to ten puffs. Although the article does not decrease in length like a conventional cigarette as it is operated, it is possible to make the article in varying lengths, with different numbers of puffs. By providing individual charges for each puff, one reduces the total amount of flavor-generating medium that must be provided, as compared with a single larger charge that would be electrically heated or reheated once for each of several puffs.

The portion of the flavor-generating article that contains the heaters and the flavor-generating medium is preferably a replaceable plug-in unit, so that when all of the charges have been heated, the spent plug-in unit can be discarded and a new one inserted. The controls and power source could be retained.

Figure 1:
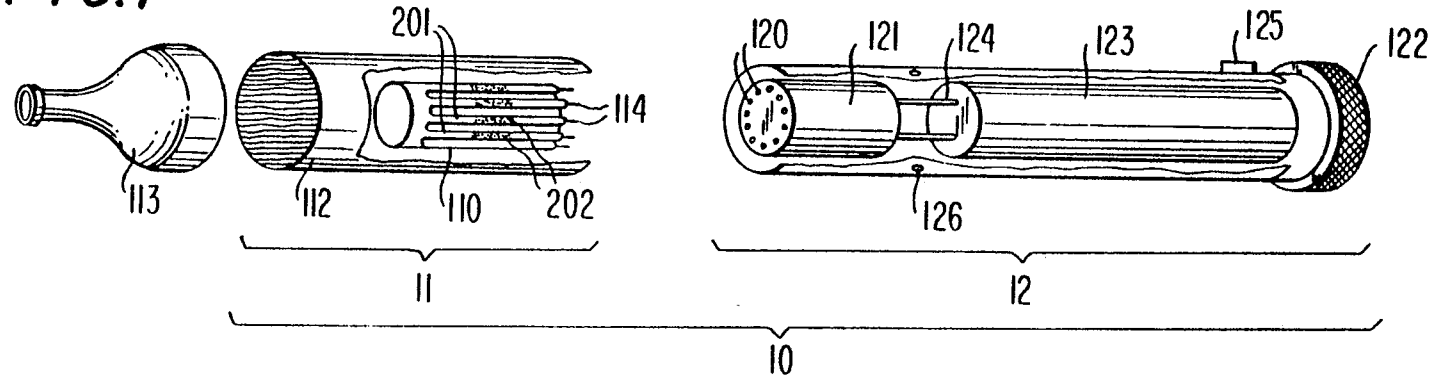
FIG. 1 is a partially fragmentary exploded cut-away perspective view of an embodiment of a smoking article including a heater according to the present invention.
Figure 2:
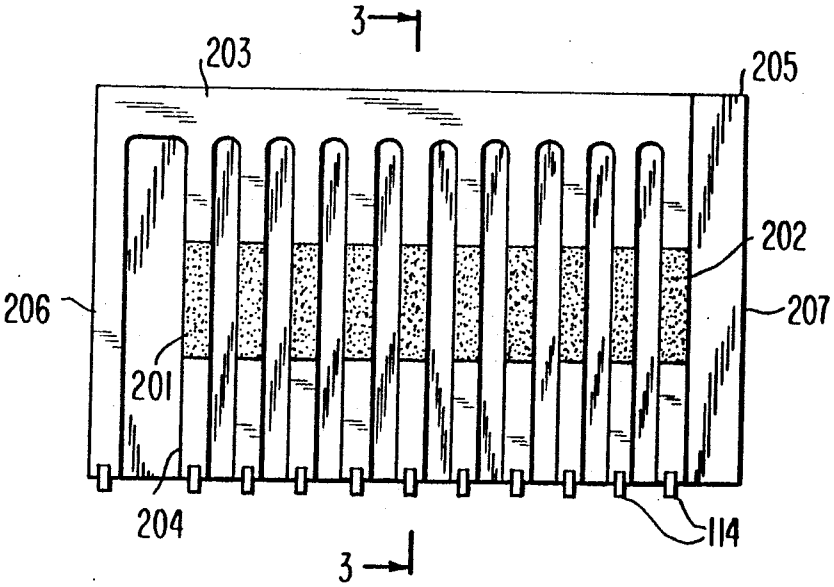
FIG. 2 is a plan view of a preferred embodiment of a heater according to the present invention.

One embodiment of the smoking article 10 according to the invention is shown in FIGS. 1 and 2. Article 10 is the simplest form of article according to the present invention, and includes heater/flavor/mouthpiece section 11 and power/control section 12. Section 11 includes a heater 110, and heater 110 further includes a plurality of heater elements 201, each having deposited on its surface a quantity of flavor-generating medium 202. The heater configuration shown in FIG. 2 is illustrative only. Different possible heater configurations will be discussed below. Preferably, there is a segment of filter material 112, such as conventional cellulose acetate or polypropylene cigarette filter material, possibly in conjunction with paper-wrapped tobacco rod sections, at the mouth end of section 11, to provide appropriate filtration efficiency and resistance-to-draw to the article. In addition, mouthpiece 113 can optionally be included.

As shown in both FIGS. 1 and 2, there are ten heater elements 201 in section 11. There are also eleven contact pins 114 extending from section 11 remote from its mouth end—one common pin and ten pins connected to individual heater elements 201—that fit into eleven sockets 120 on section 12 to make electrical contact between heater 110 and power source 121, the nature of which will be discussed in more detail below.

A knurled knob 122 is provided at the remote end of section 12 to allow the consumer to select one of the heater elements 201. Knob 122 controls a single-pole ten position rotary switch 123 connected by wires 124 to sockets 120.

To operate article 10, the consumer selects a heater element 201 using knob 122 and presses momentary-on pushbutton switch 125 to complete the circuit and energize the selected heater 201 to initiate heating. Flavor-generating medium 202, thus heated, can release or generate a flavor-containing substance. The consumer draws in the flavor-containing substance along with air drawn through perforations 126 in the outer wrapper of sections 11 or 12, which could be conventional cigarette paper or tipping paper. Air may also enter through the end of section 12 remote from the mouth end through channels that may be provided for that purpose, carrying the air around power source 121 and around other internal components of section 12. It is important that the air enter section 11 at a point at which it can fully sweep heater 110 to carry the maximum amount of flavor-generating substance to the mouth of the consumer.

When all ten charges in section 11 have been heated, section 11 is spent, and can be unplugged from section 12. A new section 11 can then be plugged in. Section 12 as envisioned is reusable.

A more preferred embodiment of an article according to the present invention includes controls that automatically select which charge will be heated, initiate heating in response to a certain stimulus (for example, the user's inhalation), and control the duration of the heating of each flavor charge.

A preferred embodiment of heater 110 is shown in FIG. 2. The entire heater is constructed on a flexible substrate 205. FIG. 2 shows a linear arrangement of heating elements 201 with a single common connection 203 and a plurality of heater element connections 204. Heating elements 201 are deposited on substrate 205. A flavor-generating medium 202 (FIG. 3) is then deposited onto each heating element. Alternatively, electrically-resistive materials are mixed with a flavor-generating medium to form the heating elements. The mixture is then printed on the substrate.

Contact pins 114 or other suitable connecting means are provided to couple the heating elements to the power supply. Referring again to FIG. 1, sockets 120 may be provided to connect heater element connections 204 to control unit 12. Each time the consumer initiates a puff, control unit 12 provides power to one or more of heating elements 201. The powered heating element heats an unused charge 202 (FIG. 3) of a flavor-generating medium, thus releasing a flavor-containing aerosol.

Flexible substrate 205 typically is a non-conductive, heat resistant material, with a low dielectric constant. In addition to flexibility, the substrate must exhibit good thermal and mechanical strength characteristics. That is, the substrate must be able to withstand extremely high temperatures (upwards of the 400°-450° C. required to extract tobacco aerosol), without releasing undesired volatiles, melting, bubbling, or otherwise losing its structural integrity or its flexibility. Certain polyamide polymers have been found to remain stable and flexible under these extreme temperature conditions. Specifically, two polymers, Upilex® vendered ICI and Kapton® vendered DuPont, exhibited no decomposition or deformation even at temperatures upwards of 500° C. Certain fibrous materials have also proven suitable for use in this invention. They include Nomex® vendered DuPont, pure cellulose paper and cloth, and paper coated with inorganic salt or sol-gel.

Common connection 203 and heating element connections 204 can be made of any low resistivity conductive material. In the preferred embodiment, the connections are formed of conductive ink which, for example, may include silver in a binder such as a polyester resin. Alternatively, the conductors may be formed of conductive epoxy.

Heater elements 201 are generally made of conductive ink with a resistance chosen such that, when a voltage is applied across common connection 203 and one of heating element connections 204, the temperature of the selected heating element rises sufficiently to release a flavor-containing aerosol from charge 202 of flavor-generating medium. The conductive ink contains an adhesive ingredient. This ingredient has two primary functions in the ink; first, cohesion of the different ingredients in the ink, and second, the adhesion of the ink to the surface of the substrate. It is important that the adhesive agent maintain dimensional integrity (i.e., it must exhibit resistance to shrinkage and creep) under high temperature gradients and high electric field stresses. It is also important that the adhesive agent be resistant to moisture. Epoxy resins are good adhesive agents towards metals, glass, ceramics, and plastics. Also, polyamide epoxy resins are thermally very stable and exhibit good adhesion properties toward polyamide substrates. It is also important that the agent be flexible. Modification of the rigidity of the cured resin can be accomplished by diluting the epoxy system with low concentrations of other, more flexible, resins. This serves to increase the average distance between cross-links, and thus creates a more flexible material.

A conductive ink should also have a solvent ingredient to dissolve the resins and other solutes and provide a uniform solution for dispersion of solid particles of interest. Suitable solvents for this invention include etheric or alcoholic solvents, such as glycol ether and isopropanol.

The ink must have a suitable conductive agent. Fine particles of conductive solids such as graphite, carbon black, and metal powders can be used as conductive agents. Among metal powders, gold and silver are preferable due to their high electrical conductivity.

The design parameters, such as the physical and electrical properties of the heater and the substrate, are all interdependent. That is, there is at least an indirect relation between the energy input, the heater dimensions, the substrate dimensions, the substrate material, the ink composition, and the energy consumption by the mass of the heater. Since a part of the useful energy is used to heat the entire system, a lower mass heater is preferred, as is a lower mass substrate.

The following equation illustrates the relation between the total energy, E, and the power, P, applied for the duration of the pulsing event, t:

$$E = \int_{o}^{t} P(t)dt = \frac{V(t)^2}{R(t)}\, dt;$$

and for constant V and R over time, $$E = \frac{V^2 t}{R}.$$

It is desired that the heater heat to at least 450° C. during a pulse of less than one second. And it has been determined that the maximum available energy input for each pulse is 2.5 calories. Considering the above-described performance criteria and energy constraints, and considering further the space limitations of the smoking article, and the 3–5 volts available from the enclosed battery, it may be preferred that the heater element have a resistance of about 1.2 ohms. With those parameters set, the heater and substrate compositions and configurations can be optimized by mathematical modeling, as follows:

$$P C_P \frac{\partial T}{\partial t} = \frac{\partial}{\partial x}\left(K_x \frac{\partial T}{\partial X}\right) + \frac{\partial}{\partial Y}\left(K_y \frac{\partial T}{\partial Y}\right) + \frac{\partial}{\partial Z}\left(K_z \frac{\partial T}{\partial Z}\right) + \overset{*}{q}$$

$$\overset{*}{q} = Vit = i^2 Rt = \frac{V^2 t}{R}$$

$$\frac{\partial}{\partial X}\ \frac{1}{R_x}\ \frac{\partial V}{\partial X} + \frac{\partial}{\partial Y}\ \frac{1}{R_y}\ \frac{\partial V}{\partial Y} + \frac{\partial}{\partial z}\ \frac{1}{R_z}\ \frac{\partial V}{\partial Z} = 0$$

where P is a density, $C_P$ is a heat capacity, T is a temperature, t is a time, K is a thermal conductivity, q is a heat generation due to the Joule heat, V is a voltage, i is a current, and R is an electrical conductivity. The above partial differential equations are solved simultaneously for each layer with the proper initial and boundary conditions.

If a highly heat resistant flexible substrate material is difficult to obtain, it is desirable to place an insulating layer between the heater and the flexible substrate. The insulating layer may be any non-conductive ceramic, inorganic, or amorphous carbon. The main goal here is to protect the flexible substrate from severe heating by reducing the heat transfer to the substrate. Also, the middle layer should have a high electrical resistivity to restrict electrical current in the layers during heating. This combination acts to partition the current density, and thus the joule heating, between the heater material and the middle layer. The majority of the heating, then, takes place in the upper layer (heater material). Materials suitable for this application include a carbon ink printed on a Mylar® (vendered DuPont) substrate.

Alternatively, and to protect the substrate if heating exceeds a critical value, it is possible to use a thermally conductive support for the substrate. Here, an example is aluminized paper, in which the paper is used as a substrate and the aluminum sub-layer is used as a conductive layer that removes the heat away from the paper and dissipates it, without allowing the paper temperature to exceed a critical value.

Screen printing may be used to apply thick (typically 0.5 to 5 mils) polymeric films in complex configurations. The viscosity of the ink must be low enough that the ink flows easily through the screen, yet high enough that it does not bleed into the non-printed areas of the substrate, that is, the ink must be thixotropic. The type of drying employed depends on the ink-solvent characteristics. When volatile solvents are used, evaporative drying with the aid of a dryer (air-jet, flame, microwave) is often used. Ultraviolet curing is the fastest method.

Because a thin film substrate may lack the mechanical strength for processing on an assembly line, it may be helpful to either pin or glue the substrate to a solid support during processing. It is preferred that the support be a light and porous, and electrically non-conductive, material, such as spongy charcoal or ceramic. The porous structure is required because it carries little weight and thus has a low thermal load. It also provides little contact with the substrate, and conducts little heat away from the heated surface.

Alternatively, a resistor or insulator may be deposited onto a polymeric substrate by thermal spraying (e.g., plasma spraying) onto the substrate a variety of transition metals, alloys, or oxide ceramics. For example, Nichrome can be plasma sprayed onto a Kapton substrate to deposit a 1.2 ohm resistor. Transition metals, alloys, and oxide ceramics are thermally stable and have low dissociation vapor pressures, and thus at high temperatures naturally exhibit high binding characteristics. Therefore, such metals, alloys, or ceramics may be deposited onto a polymeric substrate without the aid of polymeric binders, which binders may evolve undesirable gases during high temperature pulsing.

In operation, an edge 206 of substrate 205 could, for example, be bent over so as to come into proximity with edge 207 of substrate 205, and thus form a tubular-shaped heater shown as unit 110 in FIG. 1.

The screen printing process makes possible a high level of dimensional control, and allows one to design various heater configurations. FIG. 4 shows a schematic diagram of an alternative embodiment of the heater. In this embodiment, the heating elements are connected in an array such that a particular heating element can be selected with the use of a minimum number of electrical connectors. The array typically includes nine heating elements, but more or less than this number can be used. Using the square array of this invention, when n equals the number of heating elements in a row or column, it is possible to select individually any one of $n^2$ heating elements with 2 n connectors. In contrast, in a linear arrangement (e.g., as in FIG. 1) n+1 connectors are required to select any one of n heating elements.

Referring to FIG. 4, the connectors are divided into two groups termed "rows" and "columns." Conductors 401, 402, and 403 are the rows, and can be connected to a zero voltage via switches 407, 408, and 409, respectively. Conductors 404, 405, and 406 are the columns and can be connected to a power supply voltage V+ via switches 410, 411, and 412, respectively. One or more heating elements 413 can be heated by closing associated row and column switches. For example, to heat element 414, switches 408 and 411 are closed. Switches 407 through 412 may be transistors.

An array heater manufactured in accordance with this invention can be constructed on either a flexible or rigid base, and can be constructed using double-sided printing techniques. For example, row conductors 401, 402, and 403 can be printed on a first surface of the base, and column conductors 404, 405, and 406 can be printed on the second surface of the base. The heating elements may be connected between the row and column conductors via perforations in the base.

In the array configuration of FIG. 4, heating elements not selected to receive maximum power may receive some power via secondary routes. The number of secondary routes can be reduced or eliminated, for example, by incorporating a diode in series with one or more of the heating elements.

Whatever heater design is used, it is subject to several design criteria. First, the electrical resistance of the heater should be matched to the voltage of power source 121 so that the desired rate of heating is accomplished. At the same time, the resistance must be large compared to the internal resistance of power source 121 to avoid excessive losses due to the internal resistance. Second, the surface area must be sufficient to allow for support of the flavor-generating medium (with proper thickness and mass of the flavor-generating medium to allow rapid heating), and to allow for generation or release of vapors or aerosols containing flavors or other volatile components. Third, the thermal conductivity, heat capacity, and heater mass must be such that the heat generated is conducted effectively to the flavor-generating medium but not away from the heater to the surroundings, and such that excessive energy is not necessary to heat the heater itself.

The contact resistance between the heater material and the contacts should be kept low. If necessary, suitable materials, such as tantalum, can be compounded or coated at the contact points to lower contact resistance. Any materials added should be non-reactive at the operating temperatures.

Heater/flavor/mouthpiece section 11 preferably would contain heater elements as described above coated with flavor-generating medium, all wrapped in a tube, which can be made of heavy paper, to allow it to be inserted by a consumer into section 12.

Power source 121 preferably must be able to deliver sufficient energy to heat ten charges of flavor-generating medium, and still fit conveniently in the article. However, the energy to be delivered is not the only criterion, because the rate at which that energy is delivered—i.e., the power—is also important. For example, a conventional AAA-sized alkaline cell contains enough energy to heat several hundred charges of flavor-generating medium, but it is not designed to deliver the necessary energy at a sufficient rate. On the other hand, nickel-cadmium (Ni-Cad) rechargeable batteries are capable of providing much greater power on discharge. A preferred power source is four N50-AAA CADNICA nickel-cadmium cells produced by Sanyo Electric Company, Ltd., of Japan. These batteries provide 1.2-volts each, for a total of 4.8 volts when connected in series. The four batteries together supply about 264 milliwatt-hours, which is sufficient to power at least one ten-puff article without recharging. Of course, other power sources, such as rechargeable lithium-manganese dioxide batteries, can be used. Any of these types of batteries can be used in power source 121, but rechargeable batteries are preferred because of cost and disposal considerations associated with disposable batteries. In addition, if disposable batteries are used, section 12 must be able to be opened for replacement of the battery.

If rechargeable batteries, as preferred, are used, a way must be provided to recharge them. A conventional recharging unit (not shown) deriving power from a standard 120-volt AC wall outlet, or other sources such as an automobile electrical system or a separate portable power supply, can be used. The charge rate and controller circuitry must be tailored to the specific battery system to achieve optimal recharging. The recharging unit would typically have a socket into which the article, or at least section 12, would be inserted.

The energy content of a battery in power source 121 can be more fully exploited, despite the power or current limitation of the battery, if a capacitor is included in power source 121 as well. The discharge of the capacitor can be used to power heater 110. Capacitors are capable of discharging more quickly than batteries, and can be charged between puffs, allowing the battery to discharge into the capacitor at a lower rate than if it were used to power heater 110 directly.

Thus, the above-described smoking article uses a minimum number of electrical connectors to supply power selectively to individual flavor-generating charges, and has a heating array which can be manufactured by mass-production techniques. One skilled in the art will appreciate that the present invention can be practiced by other than the described embodiments. The described embodiments are thus presented for purposes of illustration, and not of limitation. The present invention is limited only by the claims which follow.

We claim:

1. A heater for an electric flavor-generating article, comprising:

a flexible substrate;

a plurality of connectors, deposited on the substrate, each connector having a free end and a connector end;

a common, deposited on the substrate, having a free end and common ends;

a plurality of heating elements, depositing on the substrate, each having a connector end and common end, the connector ends electrically connected to the connector ends of the connectors, the common ends electrically connected to the common ends of the common; and a plurality of electrical contacts, one of which is electrically connected to the free end of each of the connectors and the common.

2. The heater of claim 1 further comprising a plurality of flavor charges, one of which is deposited on each of the heating elements.

3. The heater of claim 2 wherein the flavor charges comprise a flavor-generating medium.

4. The heater of claim 3 wherein the flavor-generating medium comprises tobacco.

5. The heater of claims 3 or 4 wherein the flavor charges further comprise an aerosol-generating medium.

6. The heater of claim 5 wherein the aerosol-generating medium comprises glycerine.

7. The heater of claim 5 wherein the aerosol-generating medium comprises water.

8. The heater of claim 2 wherein the flavor charge comprises tobacco, glycerine, and calcium carbonate.

9. The heater of claim 10 wherein the adhesive agent comprises a citrus pectin.

10. The heater of claim 5 wherein the flavor charges further comprise an adhesive agent.

11. The heater of claim 2 wherein the heating elements comprise an electrically resistive material.

12. The heater of claim 11 wherein the electrically resistive material comprises conductive ink.

13. The heater of claims 1 or 2 further comprising a layer of insulating material deposited between the flexible substrate and the heating elements.

14. The heater of claim 13 wherein the insulating material is a non-conductive ceramic, inorganic, or amorphous carbon.

15. The heater of claims 1 or 2 wherein the flexible substrate comprises a non-conductive, heat-resistant material, with a low dielectric constant.

16. The heater of claim 15 wherein the flexible substrate comprises a polyamide polymer.

17. The heater of claim 16 wherein the heating elements comprise transition metals or alloys, or oxide ceramics.

18. The heater of claim 17 wherein the heating elements comprise an alloy comprising 59–80% nickel, 10–20% chromium, 7–27% iron, 0–11% copper, 0–5% manganese, and 0.3–4.6% silicon.

19. The heater of claim 15 wherein the flexible substrate comprises a fibrous material.

20. The heater of claims 1 or 2 wherein the connectors comprise a low resistivity electrically conductive material.

21. The heater of claim 20 wherein the connectors comprise conductive ink.

22. The heater of claim 21 wherein the conductive ink comprises silver and a polyester resin.

23. The heater of claim 20 wherein the connectors comprise a conductive epoxy.

24. The heater of claims 1 or 2 wherein the common comprises a low resistivity electrically conductive material.

25. The heater of claim 24 wherein the common comprises conductive ink.

26. The heater of claim 24 wherein the common comprises a conductive epoxy.

27. The heater of claim 1 wherein the heating elements comprise an electrically resistive material.

28. The heater of claim 27 wherein the electrically resistive material comprises conductive ink.

29. The heater of claim 27 wherein the heating elements further comprise a flavor-generating medium.

30. The heater of claim 29 wherein the flavor-generating medium comprises tobacco.

31. The heater of claim 29 wherein the heating elements further comprise an aerosol-generating material.

32. The heater of claims 28 or 12 wherein the conductive ink comprises in a mixture:

an adhesive agent;

a solvent agent; and a conductive agent.

33. The heater of claim 32 wherein the adhesive agent comprises an epoxy resin.

34. The heater of claim 32 wherein the adhesive agent comprises a polyamide epoxy resin.

35. The heater of claim 32 wherein the solvent agent comprises an etheric solvent.

36. The heater of claim 35 wherein the etheric solvent is glycol ether.

37. The heater of claim 32 wherein the solvent agent comprises an alcoholic solvent.

38. The heater of claim 37 wherein the alcoholic solvent is isopropanol.

39. The heater of claim 32 wherein the conductive agent comprises graphite.

40. The heater of claim 32 wherein the conductive agent comprises carbon black.

41. The heater of claim 32 wherein the conductive agent comprises metal powder.

42. The heater of claim 41 wherein the metal powder is gold.

43. The heater of claim 41 wherein the metal powder is silver.

44. The heater of claims 1, 2, or 27 wherein each of the heating elements has an electrical resistance of about 1.2 ohms.

45. The heater of claim 44 wherein each of the heating elements is individually powered by a portable energy device, having a negative terminal and a positive terminal, the negative terminal electrically connected to the electrical contact at the common, the positive terminal switchably electrically connected to the electrical contacts at the connectors.

46. The heater of claim 45 wherein the portable energy device has a high power density.

47. The heater of claim 46 wherein the portable energy device comprises a Ni-Cad battery, a polymer battery, or a lithium-manganese dioxide battery.

48. The heater of claim 47 wherein the portable energy device further comprises a capacitor.

49. The heater of claim 45 wherein the portable energy device has a voltage of about 3.6 V.

50. The heater of claims 1 or 2 further comprising a thermally conductive support for the flexible substrate, the thermally conductive support layered on the surface of the flexible substrate so as to remove from the substrate and dissipate any excess heat 51. The heater of claim 50 wherein the thermally conductive support comprises aluminum.

52. The heater of claims 1 or 2 wherein the electrical contacts have a low contact resistance.

53. The heater of claim 52 wherein the electrical contacts are coated with tantalum.

54. A heater for an electric flavor-generating article, comprising:

a substrate;

a plurality of electrically conductive row connector strips, disposed in rows on the substrate, switchably connected to ground;

a plurality of electrically conductive column connector strips, disposed in columns on the substrate, switchably connected to a power supply voltage; and a plurality of heating elements, each having a first terminal and a second terminal, the heating elements connected in an array wherein the first terminal of each heating element is electrically connected to one of the row connector strips, and the second terminal of each heating element is electrically connected to one of the column connector strips, such that at least one of the heating elements can be selectively heated by selectively coupling at least one of the row connector strips with ground, and selectively coupling at least one of the column connector strips with the power supply voltage.

55. The heater of claim 54 wherein the substrate is flexible.

56. The heater of claims 54 or 55 further comprising at least one diode electrically connected in series with at least one heating element.

57. The heater of claim 54 wherein the row connectors are disposed on one side of the substrate, the column connectors are disposed on the other side of the substrate, and the heating elements are disposed through perforations in the substrate such that the first terminal of each heating element is connected to a row connector, and the second terminal of each heating element is connected to a column connector.

* * * * *